US007717689B2

(12) United States Patent
Sato et al.

(10) Patent No.: US 7,717,689 B2
(45) Date of Patent: May 18, 2010

(54) ROTOR APPARATUS OF PUMP INCLUDING A DRIVE SHAFT WITH A PLURALITY OF ARCUATE CIRCUMFERENTIAL SURFACE SECTIONS

(75) Inventors: Chikashi Sato, Saitama-ken (JP); Masahiro Kasahara, Gunma-ken (JP)

(73) Assignees: Honda Motor Co., Ltd., Tokyo (JP); Yamada Manufacturing Co., Ltd., Kiryu-shi (JP)

( * ) Notice: Subject to any disclaimer, the term of this patent is extended or adjusted under 35 U.S.C. 154(b) by 697 days.

(21) Appl. No.: 11/516,048

(22) Filed: Sep. 6, 2006

(65) Prior Publication Data

US 2007/0059194 A1 Mar. 15, 2007

(30) Foreign Application Priority Data

Sep. 9, 2005 (JP) ..... 2005-262704

(51) Int. Cl.
*F03C 2/00* (2006.01)
*F03C 4/00* (2006.01)
*F04C 18/00* (2006.01)

(52) U.S. Cl. ..... 418/171; 418/102; 418/109; 403/383

(58) Field of Classification Search ..... 418/102, 418/166, 171, 170, 109, 152, 178, 179; 403/383
See application file for complete search history.

(56) References Cited

U.S. PATENT DOCUMENTS 5,215,165 A * 6/1993 Torii ..... 418/171
5,407,295 A * 4/1995 Kuhl ..... 403/350
6,116,878 A * 9/2000 Miura ..... 418/171

FOREIGN PATENT DOCUMENTS

DE 19605718 A1 * 8/1996
JP 2005-16448 1/2005

* cited by examiner

*Primary Examiner*—Theresa Trieu
(74) *Attorney, Agent, or Firm*—McGinn IP Law Group, PLLC

(57) ABSTRACT

To provide a rotor apparatus of a pump in which pressure release in the air gap between an oil seal and an inner rotor is conducted smoothly and good durability and sealing ability of the oil seal is maintained and which has a very simple structure and allows the increase in size to be avoided. The rotor apparatus of a pump includes a drive shaft in which a plurality of arcuate circumferential surface sections centering on an axial center and a plurality of flat surface sections are disposed alternately, and an inner rotor having a mounting hole into which the drive shaft is inserted. In the mounting hole, arcuate inner peripheral sections corresponding and equal in number to the arcuate circumferential surface sections and flat surface inner peripheral sections corresponding and equal in number to the flat surface sections are formed alternately.

20 Claims, 17 Drawing Sheets

ROTOR APPARATUS OF PUMP INCLUDING A DRIVE SHAFT WITH A PLURALITY OF ARCUATE CIRCUMFERENTIAL SURFACE SECTIONS

BACKGROUND OF THE INVENTION

1. Field of the Invention

The present invention relates to a rotor apparatus of a pump capable of conducting smoothly the release of pressure in an air gap section between an oil seal and an inner rotor and maintaining good durability and sealing performance of the oil seal, and also having a very simple structure and making it possible to avoid the increase in size.

2. Description of the Related Art

Pressure release from an air gap section between an oil seal and an inner rotor is one of the tasks associated with rotor apparatuses of pumps and the like. In a structure of a rotor apparatus of a pump, the inner rotor and drive shaft (crank shaft) of the rotor apparatus of the pump are linked together, but in the oil pumps, an oil seal manufactured from an elastic body (rubber or the like) is mounted on the pump body of the oil pump and a drive shaft (crankshaft) is inserted into the open section of the oil pump. The lip sites of the oil seal are lubricated with the oil located inside the oil pump and the oil seal prevents the oil located in the oil pump from flowing out to the outside of the pump (oil leak).

SUMMARY OF THE INVENTION

Pressure release in the air gap section that is present between a rotor apparatus such as an inner rotor and an outer rotor attached to a rotor chamber and the oil seal attached to the pump casing is one of the tasks associated with the pumps having a rotor mechanism of an inner contact type. Thus, in a pump comprising a rotor mechanism of an inner contact type, an inner rotor and a drive shaft (crankshaft) are connected, and an oil seal manufactured from an elastic body (rubber or the like) is attached to a pump casing of the oil pump.

The drive shaft (crankshaft) is inserted into an open section of the oil seal. The lip sites of the oil seal are lubricated with the oil located inside the oil pump and the oil seal prevents the oil located in the oil pump from flowing out to the outside of the pump (oil leak).

Because the fluid (oil and the like) is retained in the air gap present between the oil seal and the rotor and the pressure of the fluid located in this air gap rises during operation, an excess load caused by this pressure is applied to the oil seal, thereby creating a risk of durability and sealing ability of the oil seal being degraded. Accordingly, Japanese Patent Application Laid-open No. 2005-16448 discloses communicating the air gap with the pump chamber via a clearance formed along the axial direction of the drive shaft between the inner peripheral surface of the axial hole of the rotor such as an inner rotor and the drive shaft rotating the rotor and removing the fluid under a high pressure that is located inside the air gap from the air gap into the pump chamber as means for conducting pressure release that inhibits the increase in pressure of the fluid retained in the air gap.

The technical contents of the Japanese Patent Application Laid-open No. 2005-16448 is characterized in that the mounting hole of the inner rotor has a cross-sectional shape comprising four main circular-arc sections and four linear connecting sections for connecting the adjacent main circular-arc sections on the same circle. In the inner rotor, there are four corners in the rotation direction locations that are formed by the main circular-arc sections and linear connecting sections, and stress concentration from the drive shaft (crankshaft) is relaxed.

However, when the clearance (communication channel) between the drive shaft and the inner rotor is narrow, the pressure release is sometimes incomplete. For this reason, increasing the clearance to release the pressure can be considered. However, if the clearance with the drive shaft in the configuration of Japanese Patent Application Laid-open No. 2005-16448 is increased by enlarging the four main circular-arc sections of the mounting hole of the inner rotor, then the thickness of the main circular-arc sections of the mounting hole and the tooth bottoms of the tooth profile (for example, trochoid tooth profile) on the outer periphery of the inner rotor is decreased, thereby adversely affecting the strength.

If a sufficient thickness is wished to be ensured with the foregoing in view, the diameter of the inner rotor has to be increased causing undesirable increase in size and weight of the oil pump. Accordingly, a problem (technical task or object) to be solved by the present invention is to enable sufficient pressure release and maintain good oil durability and sealing ability of the oil seal, without increasing the inner rotor in size.

Accordingly, the inventors solved the above-described problem with the invention relating to a rotor apparatus of a pump comprising: a drive shaft in which a plurality of arcuate circumferential surface sections centering on an axial center and a plurality of flat surface sections are disposed alternately; and an inner rotor having a mounting hole into which the drive shaft is inserted, wherein in the mounting hole, arcuate inner peripheral sections corresponding and equal in number to the arcuate circumferential surface sections and flat surface inner peripheral sections corresponding and equal in number to the flat surface sections are formed alternately, and centers of the arcuate inner peripheral sections are displaced with respect to an axial center of the inner rotor and also radii of the arcuate inner peripheral sections are made larger than the radii of the arcuate circumferential surface sections, so that the axial center of the inner rotor is positioned between each arcuate inner peripheral section and a center of the radius corresponding to each arcuate inner peripheral section.

Further, the above-described problem is solved by the rotor apparatus of a pump of the above-described configuration, wherein the center of the arcuate inner peripheral section is set in a position almost identical to that on a line passing through a middle point of an arc span length of the arcuate inner peripheral section and the axial center of the inner rotor. The above-described problem is solved by the rotor apparatus of a pump of the above-described configuration, wherein the off-center distances of centers of all the arcuate inner peripheral sections are the same.

The above-described problem is solved by the rotor apparatus of a pump of the above-described configuration, wherein the off-center distance m of at least one of the centers of all the arcuate inner peripheral sections is different from the off-center distance of others. The above-described problem is solved by the rotor apparatus of a pump of the above-described configuration, wherein the radii of all the arcuate inner peripheral sections are the same.

The above-described problem is solved by the rotor apparatus of a pump of the above-described configuration, wherein the radius of at least one of all said arcuate inner peripheral sections is different from the radii of others. The above-described problem is solved by the rotor apparatus of a pump of the above-described configuration, wherein a middle point of an arc span length of all the arcuate inner peripheral sections is in a position corresponding to the deepest section of a tooth bottom of the inner rotor.

The above-described problem is solved by the rotor apparatus of a pump of the above-described configuration, wherein corners of all the arcuate inner peripheral sections and flat surface inner peripheral sections are recessed arc-like corner sections. The above-described problem is solved by the rotor apparatus of a pump of the above-described configuration, wherein in the flat surface inner peripheral section, an escape groove is formed along an axial direction and the escape groove is formed in the flat surface inner peripheral section and in a position corresponding to a position of a tooth tip of the inner rotor.

A clearance of an especially large opening surface area is formed between the arcuate circumferential surface sections of the drive shaft and the arcuate inner peripheral sections of the mounting hole of the inner rotor, and this clearance can serve as a pressure release channel section. The pressure release channel section frees the high-pressure fluid retained in the air gap formed between the rotor chamber and the oil seal, thereby inhibiting the rise of pressure inside the air gap, and makes it possible to maintain good sealing ability and durability of the oil seal.

Furthermore, this pressure release channel section is formed by the arcuate circumferential surface sections of the drive shaft and the arcuate inner peripheral sections of the inner rotor. Moreover, the axial center of the inner rotor is positioned between each arcuate inner peripheral section and centers of the radii corresponding to each arcuate inner peripheral section, the centers of the arcuate inner peripheral sections are displaced with respect to an axial center of the inner rotor and also radii of the arcuate inner peripheral sections are made larger than the radii of the arcuate circumferential surface sections. Therefore, the opening surrounded by the arcuate circumferential surface sections and arcuate inner peripheral sections can assume a shape that expands gradually toward both sides from the center in the arc span length of the arcuate inner peripheral sections and arcuate circumferential surface sections. Such pressure release channel section makes it possible to minimize the reduction of thickness in the radial direction of the inner rotor and is less than the pressure release channel section constituted by the arcuate inner peripheral sections formed by the circle concentric with the axial center of the inner rotor (based on the conventional technology).

The radial center of the arcuate inner peripheral section is set on a line passing through a middle point b of an arc span length of the arcuate inner peripheral section and the axial center of the inner rotor. Therefore, when the mounting hole of the inner rotor is molded, the operations can be performed easily and efficiently. Furthermore, the off-center distances from the axial center of the inner rotor in the center of all the arcuate inner peripheral sections are the same, whereby an inner rotor with a uniform shape is obtained and productivity can be improved.

The off-center distance of at least one center of the centers of all the arcuate inner peripheral sections from the axial center of the inner rotor is different from the off-center distance of other centers. Therefore, the pressure release channel section formed between the mounting hole of the inner rotor and the drive shaft can have respectively different opening surface areas, the rhythm during pressure release actuation can be broken and, therefore, the occurrence of pulsations can be prevented. Furthermore, a rotor apparatus of a pump is provided in which the radii of the arcuate inner peripheral sections in the above-described configuration are the same and, therefore, the operation of molding the mounting hole can be conducted efficiently.

Further, the radius of at least one of all the arcuate inner peripheral sections is different from the radius of other arcuate inner peripheral sections. Therefore, the pressure release channel sections can have different surface areas in each arcuate inner peripheral section and the rhythm during pressure release actuation can be broken and, therefore, the occurrence of pulsations can be prevented. Furthermore, a middle point of an arc span length of all the arcuate inner peripheral sections is in a position corresponding to the deepest section of a tooth bottom of the inner rotor. Therefore, the reduction in thickness in the tooth bottom portion of the inner rotor can be minimized, the opening surface area of the pressure release channel section gradually increases to both sides in the width direction of the deepest section, and good pressure release operation can be maintained.

Further, the corners of all the arcuate inner peripheral sections and flat surface inner peripheral sections are recessed arc-like corner sections, wherein the corner sections of the arcuate inner peripheral sections and flat surface sections of the drive shaft are not brought into contact and scoring can be prevented. Further, an escape groove can be is formed without reducing the thickness of the inner rotor in the location where the drive shaft and mounting hole come into contact during rotation and without loosing the strength of the inner rotor, and with such escape groove, the release of pressure in the air gaps can be performed more smoothly.

DESCRIPTION OF THE PREFERRED EMBODIMENTS

Figure 8A:
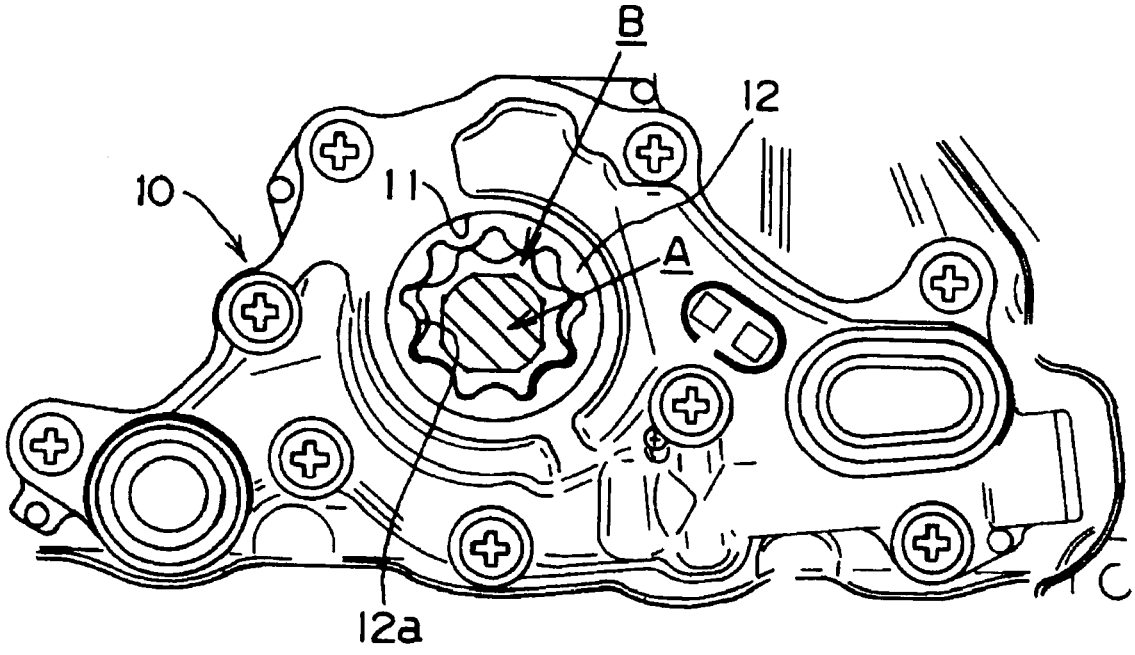
FIG. 8A is a front view of the pump casing, 8B is a vertical sectional side view of the pump casing.
Figure 8B:
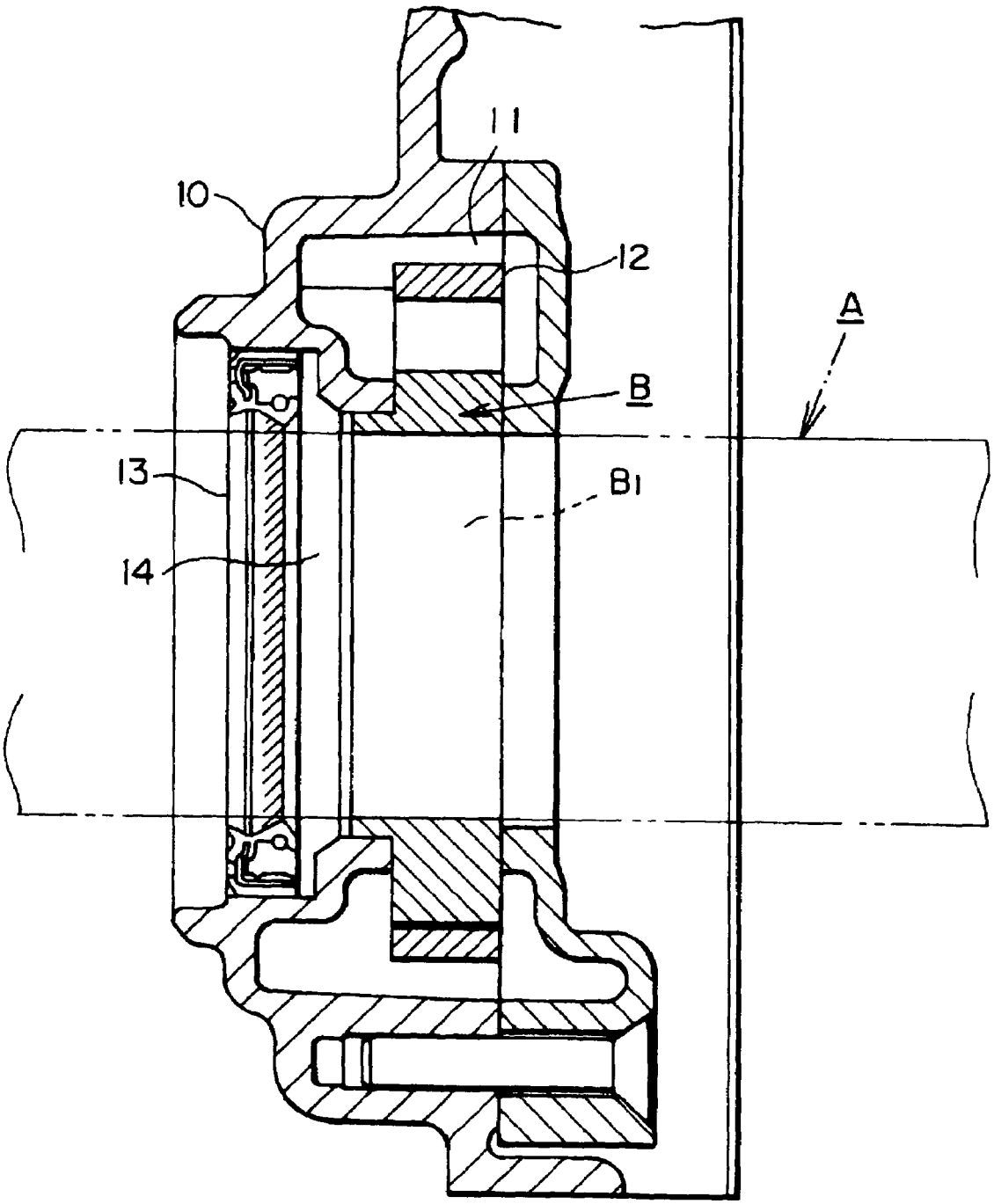

An embodiment of the present invention will be explained below based on the drawings. The present invention relates to a drive shaft A and an inner rotor B. As shown in FIGS. 8A, 8B, a rotor is contained in a rotor chamber 11 formed in a pump casting 10, and a drive shaft A for rotary driving the rotor is attached thereto.

The rotor has a rotor structure of an inner contact type, and more particularly comprises a combination of an inner rotor B and an outer rotor 12 having trochoid teeth. In the pump casing 10, an oil seal 13 for sealing an external section and an internal section is attached in a protrusion location of the drive shaft A. A spacer is located between the rotor chamber 11 and the oil seal 13; this spacer will be termed a gap section 14 (see FIG. 8B).

Figure 1A:
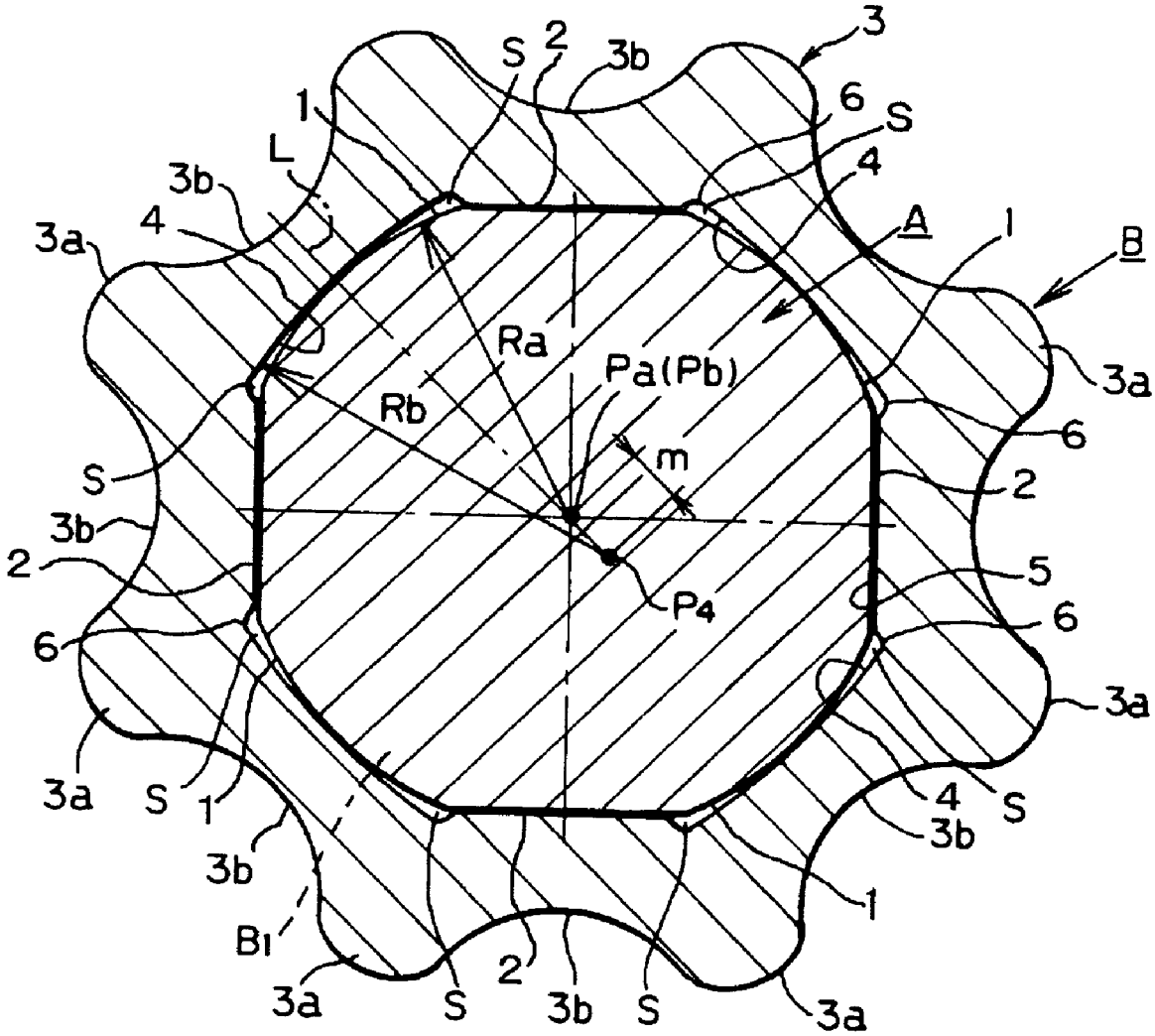
FIG. 1A is a vertical sectional front view of the drive shaft and inner rotor of the present invention, 1B is a vertical sectional front view of the drive shaft, 1C is a vertical sectional front view of the inner rotor.
Figure 1B:
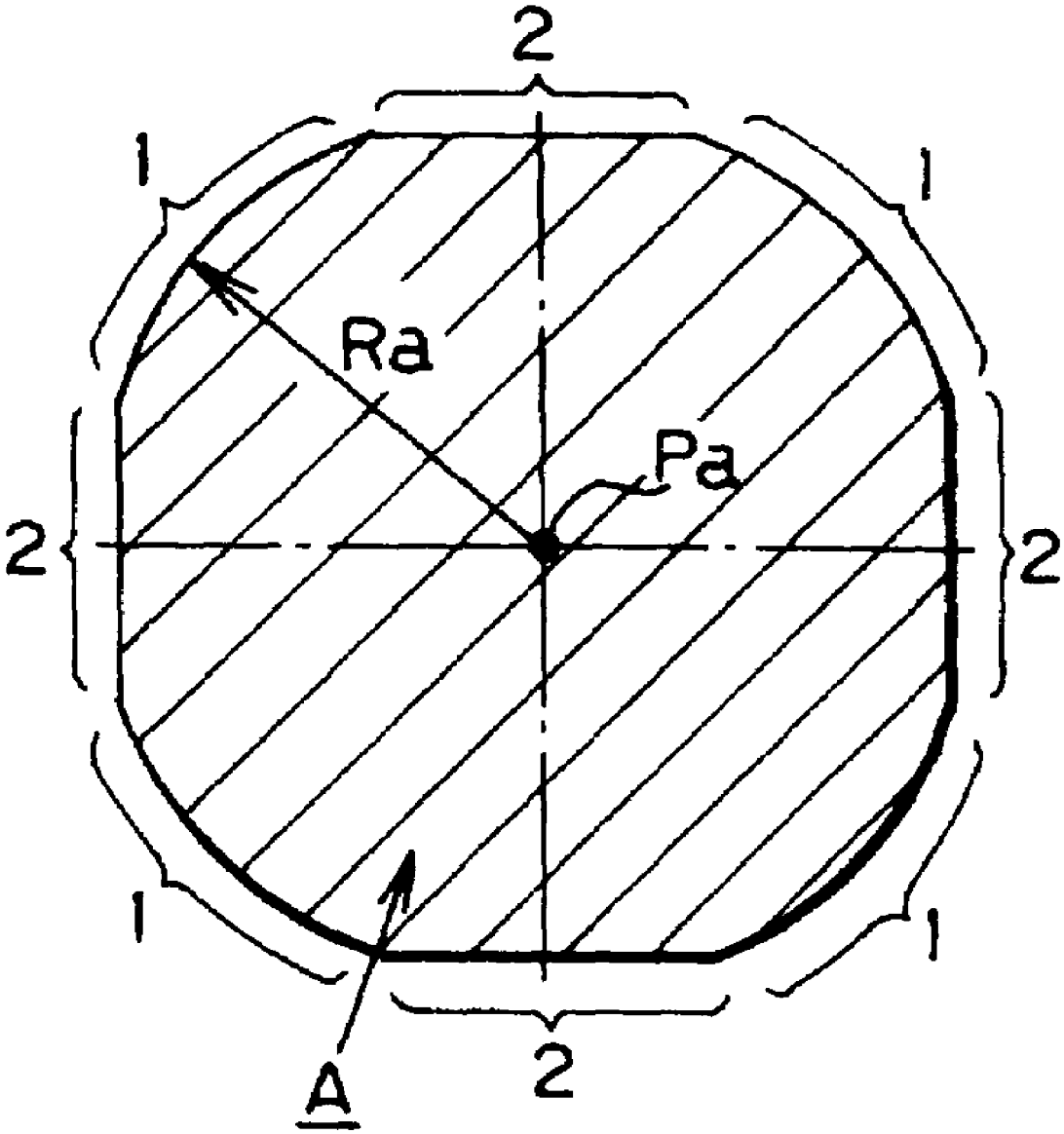

The drive shaft A, as shown in FIG. 1B, has a plurality of arcuate circumferential surface sections 1 and a plurality of flat surface sections 2 disposed alternately to form the outer peripheral side surface of the shaft. More specifically, four arcuate circumferential surface sections 1, 1, . . . and four flat surface sections 2, 2, . . . are disposed alternately, thereby constituting the outer peripheral side surface of the shaft. The arcuate circumferential surface section 1 is a circular-arc configuration of an appropriate range formed with the axial center Pa of the drive shaft A as radial center thereof and within a region narrower than an about (¼) of the circular arc section. The flat surface section 2 is a zone with a flat surface, and when those arcuate circumferential surface sections 1 and flat surface sections 2 are viewed in a cross section orthogonal to the axial direction of the drive shaft A, they form a configuration in which circular arc and straight lines are disposed alternately.

The formation ranges of the arcuate circumferential surface sections 1, 1, . . . are disposed equiangularly and equidistantly with respect to the axial center Pa of the drive shaft A. Furthermore, the number of the arcuate circumferential surface sections 1 is the same as the number of the flat surface sections 2. As shown in FIG. 1B, the drive shaft A composed of four arcuate circumferential surface sections 1, 1, . . . and four flat surface sections 2, 2, . . . and the inner rotor B corresponding to this drive shaft A will be mainly explained, but the present invention is not necessarily limited to those numbers.

Figure 5A:
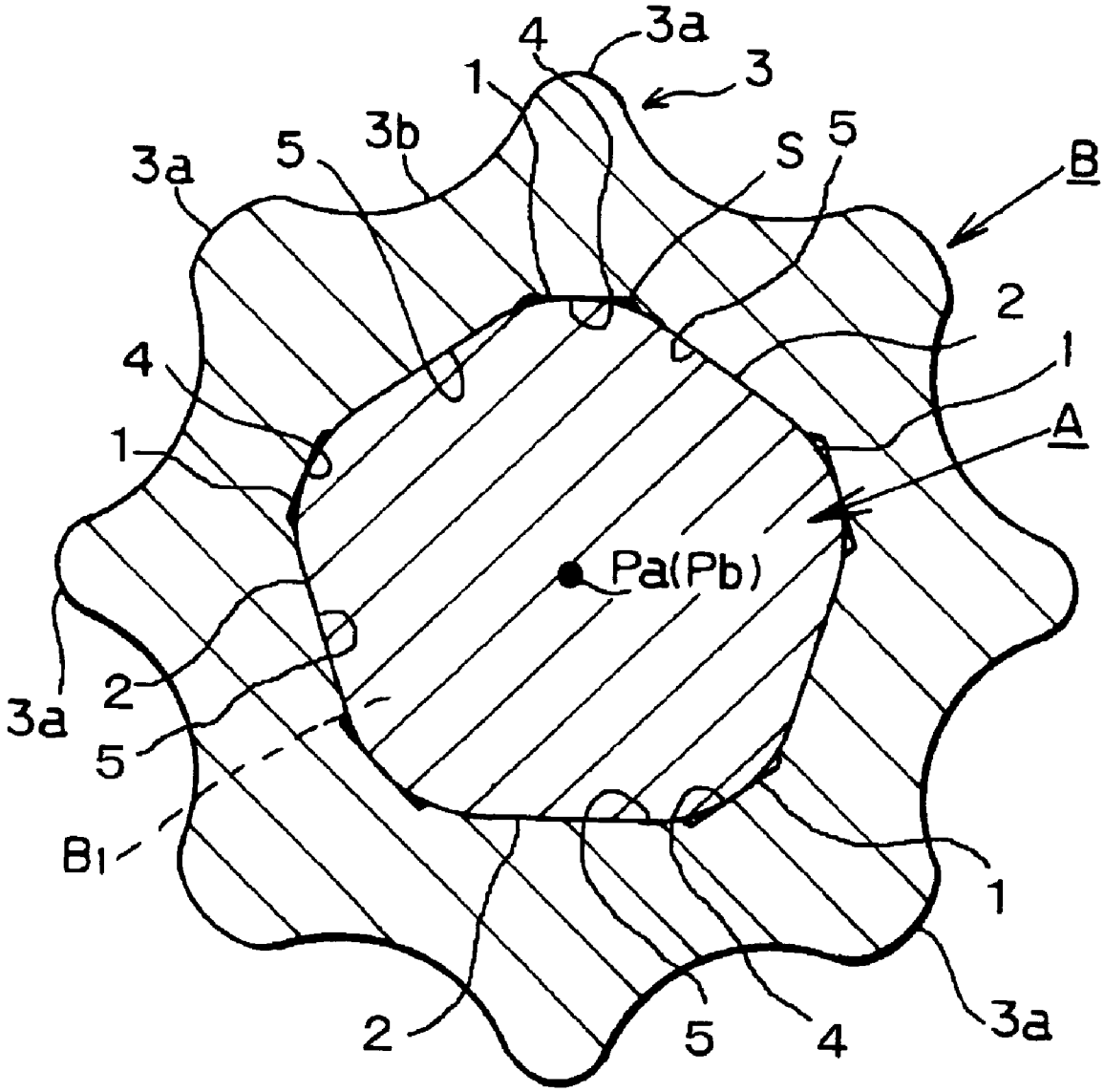
FIG. 5A is a vertical sectional front view in which the drive shaft and the mounting hole of the inner rotor have a pentagonal shape, 5B is the enlarged view of the main part of 5A.
Figure 5B:
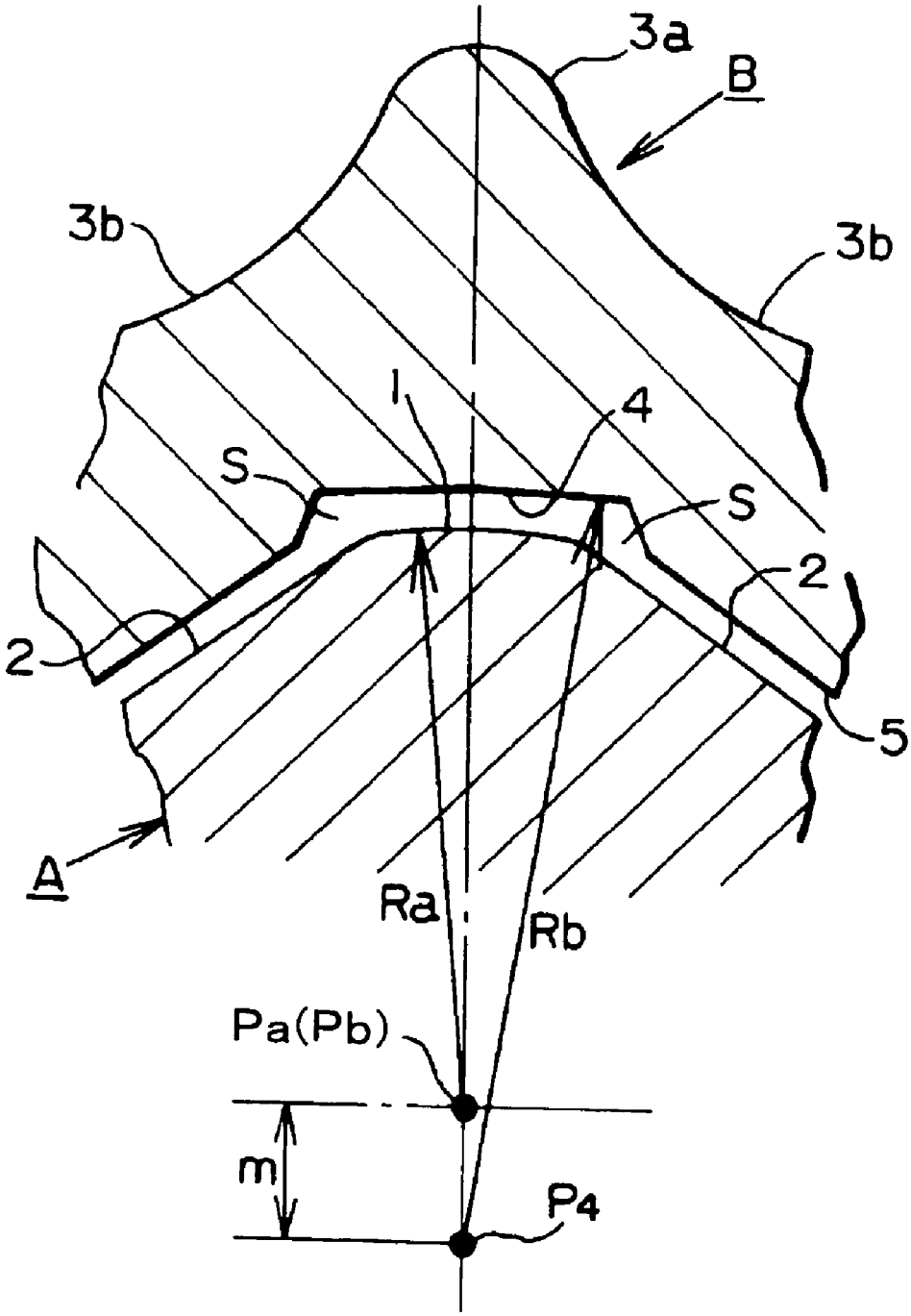
Figure 6A:
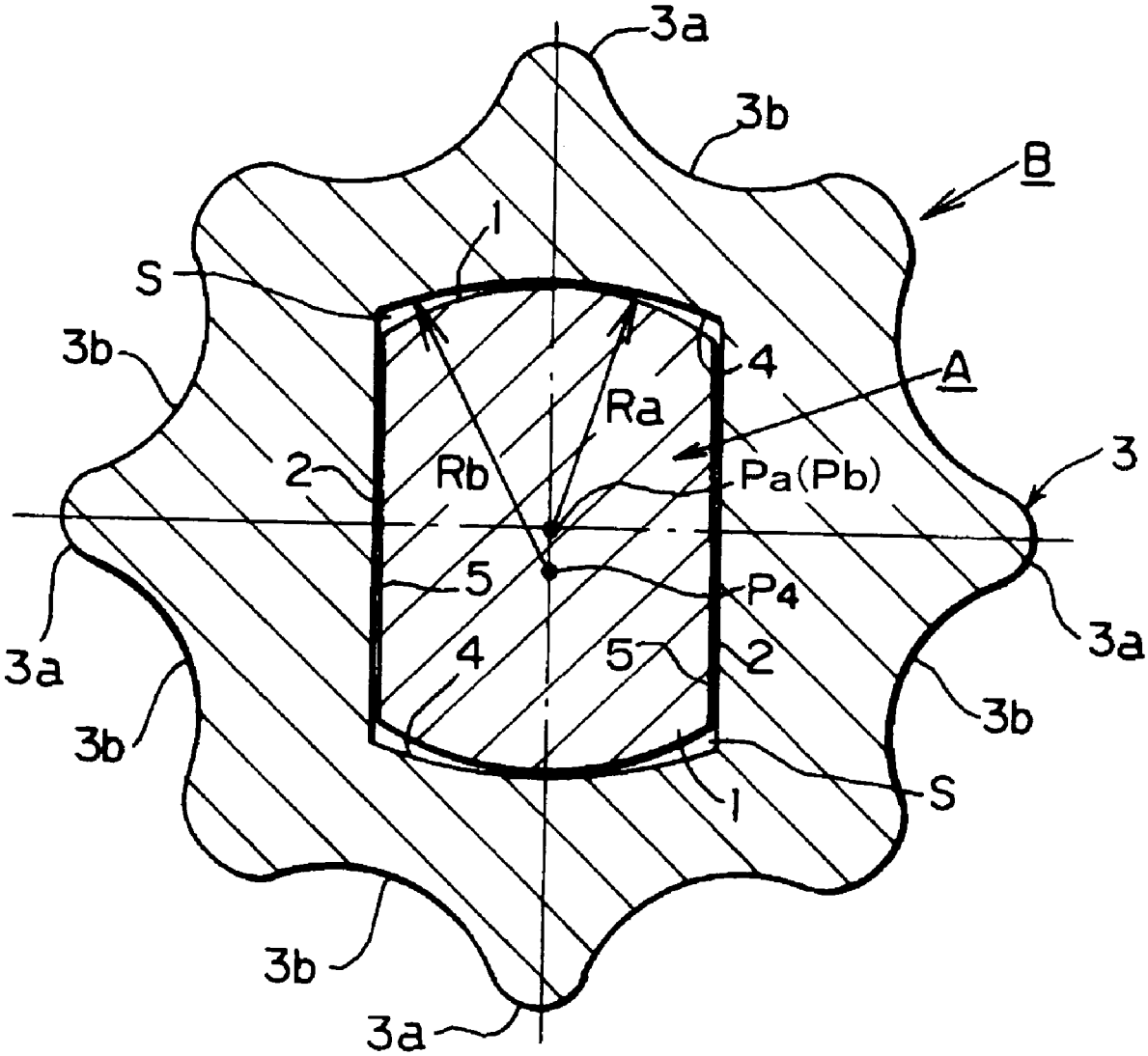
FIG. 6A is a vertical sectional front view in which the drive shaft and the mounting hole of the inner rotor have an elliptical shape, 6B is the enlarged view of the main part of 6A.
Figure 6B:
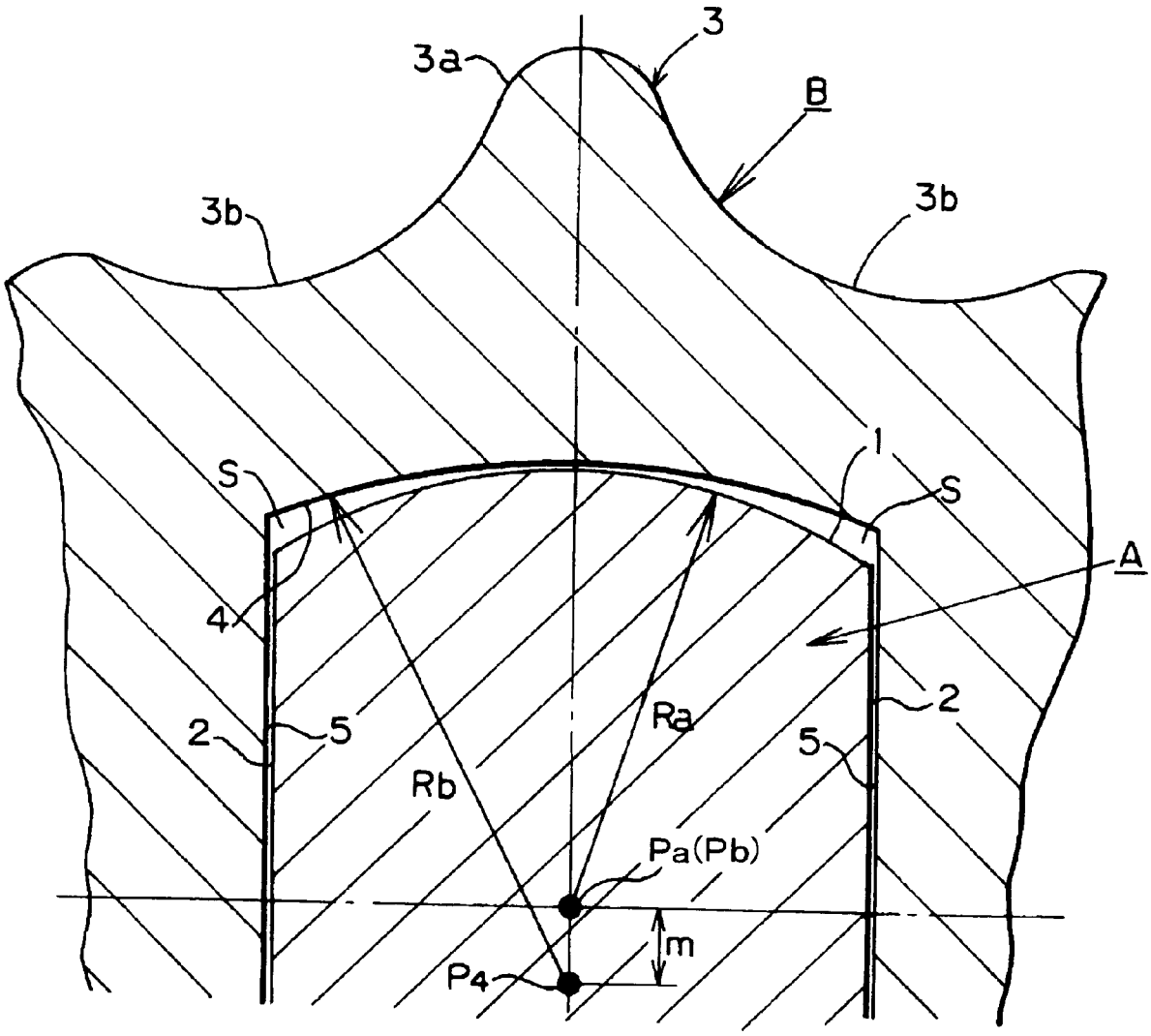

For example, a combination is possible of a drive shaft A composed of five or more arcuate circumferential surface sections 1 and the flat surface sections 2 in the number corresponding to that of the arcuate circumferential surface sections 1, and a corresponding inner rotor B. As an example, FIG. 5 shows a configuration with a pentagonal cross section of the drive shaft A that is composed of five arcuate circumferential surface sections 1 and five flat surface sections 2. Furthermore, the below described mounting hole $B_1$ is also formed as a pentagonal hole. In FIG. 6, a drive shaft A is composed of two arcuate circumferential surface sections 1 and two flat surface sections 2.

Figure 1C:
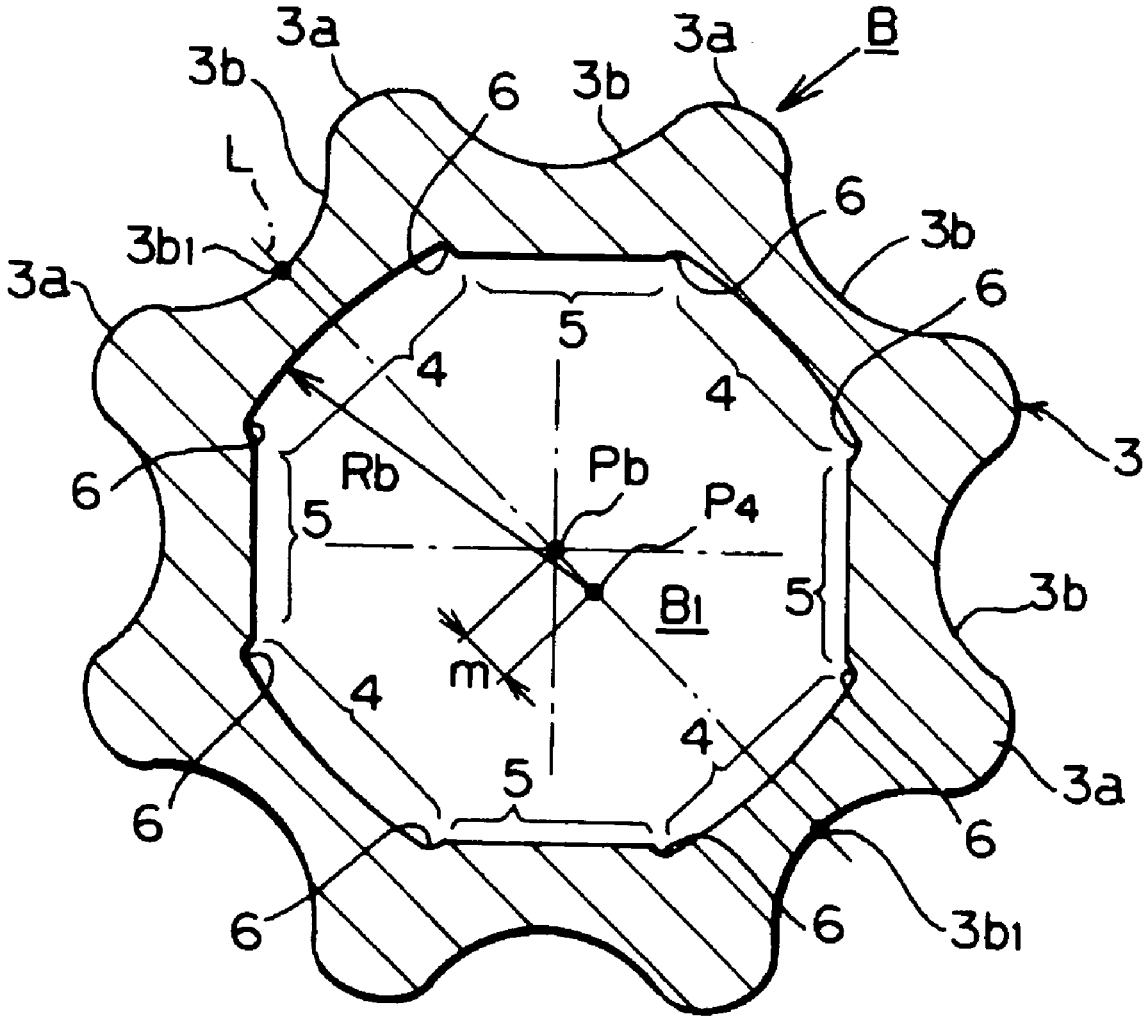

Further, the inner rotor B, as shown in FIG. 1C, has a trochoid tooth section 3 formed on the outer peripheral side surface thereof; in this trochoid tooth section 3, tooth peaks 3*a* and tooth bottoms 3*b* are formed alternately. The deepest portion of the tooth bottom 3*b* will be termed a deepest section $3b_1$. A trochoid tooth profile 12*a* is formed on the inner peripheral side surface of the outer rotor 12. As the inner rotor is rotated by the drive shaft A, the outer rotor 12 is also rotated, a cell is formed by the two trochoid tooth profiles, and a fluid such as an oil is transferred by the cell from a suction port formed inside the rotor chamber to a discharge port.

Around an axial center Pb, which is the radial direction center of the inner rotor B, a mounting hole $B_1$ is formed. The mounting hole $B_1$, as shown in FIG. 1C, is composed of arcuate inner peripheral sections 4 and flat surface inner peripheral sections 5. The drive shaft A is inserted into the mounting hole $B_1$, the arcuate circumferential surface sections 1 and the arcuate inner peripheral sections 4 are set into corresponding positions, and the flat surface sections 2 and the flat surface inner peripheral sections 5 are set into corresponding positions (see FIG. 1A). In a state where the drive shaft A is inserted into the mounting hole $B_1$ of the inner rotor B, the positions of the axial center Pb of the inner rotor B and the axial center Pa of the drive shaft A match. However, a slide displacement of the axial center Pa and axial center Pb caused by a clearance present between the mounting hole $B_1$ and the drive shaft A will also be considered with a range of matching (see FIG. 1A).

Figure 2A:
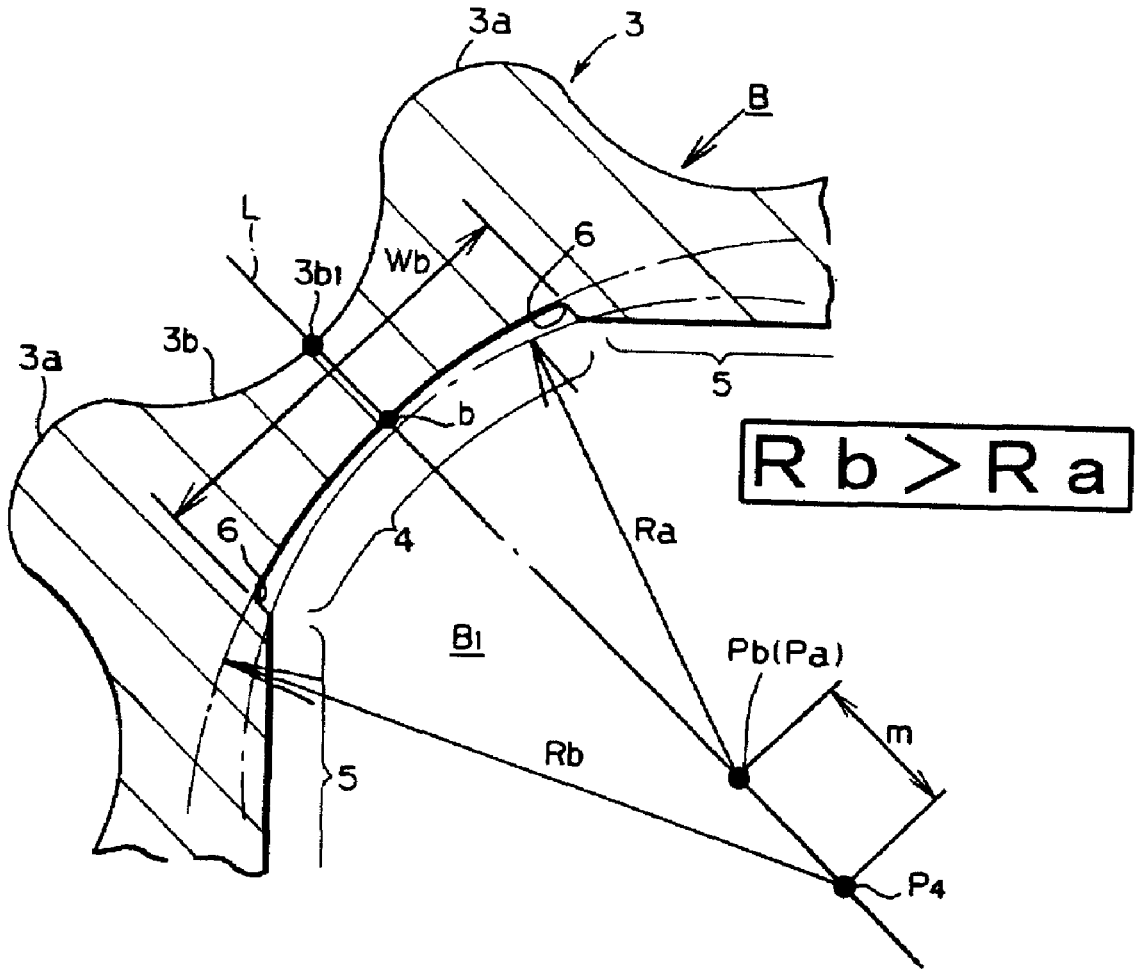
FIG. 2A is an enlarged cross-sectional view of the arcuate inner peripheral section location of the inner rotor, 2B is an enlarged cross-sectional view of a pressure release channel section location formed by the arcuate inner peripheral section of the inner rotor and the arcuate circumferential surface section of the drive shaft.

If the center of the radius corresponding to the arcuate inner peripheral section 4 in the mounting hole $B_1$ is taken as a center $P_4$ of the arcuate inner peripheral section 4, this arcuate inner peripheral section 4, as shown in FIG. 2A, does not match the position of the axial center Pb of the inner rotor B, and the center $P_4$ of the arcuate inner peripheral section is located in a position displaced with respect to the axial center Pb. More specifically, the axial center Pb of the inner rotor B is positioned between the arcuate inner peripheral section 4 and the center $P_4$.

Furthermore, in this state, the center $P_4$ of the radius corresponding to the arcuate inner peripheral section 4 is present in a position displaced with respect to the axial center Pb. In other words, the position of the center $P_4$ of the radius corresponding to the arcuate inner peripheral section 4 is farther than the axial center Pb and closer to the other arcuate inner peripheral section 4 positioned on the opposite side facing this arcuate inner peripheral section 4, and this center $P_4$ assumes a position displaced with respect to the axial center Pb (see FIG. 1C).

Here, when a configuration is described in which the axial center Pb of the inner rotor B is positioned between the arcuate inner peripheral section 4 and the center $P_4$ of the radius corresponding to the arcuate inner peripheral section 4, the expression "between the arcuate inner peripheral section 4 and the center $P_4$ of the radius corresponding to the arcuate inner peripheral section 4" does not represent a portion limited to a line connecting one appropriate point of the arcuate inner peripheral section 4 and the center $P_4$ of the radius corresponding to the arcuate inner peripheral section 4 and includes the entire region of the fan-shaped portion formed by the formation range of the arcuate inner peripheral section 4 and the center $P_4$ of the radius corresponding to the arcuate inner peripheral section 4. Furthermore, the radius Rb of the arcuate inner peripheral section 4 is larger than the radius Ra of the arcuate circumferential surface section 1. Thus, radius Rb>radius Ra (see FIG. 2B).

The arcuate inner peripheral section 4 that is thus formed is formed via steps with respect to the flat surface inner peripheral sections 5,5 positioned on both sides of the arcuate inner peripheral section 4, so that the arcuate inner peripheral section recedes toward the outer peripheral side in the radial direction of the inner rotor B. The step locations between the arcuate inner peripheral section 4 and the adjacent flat surface inner peripheral sections 5 will be termed arc-like corner sections 6. The arc-like corner sections 6 are preferably formed in the shape of almost circular arcs, as shown in FIG. 1C and FIG. 2A. The arc-like corner sections 6 provide for smooth connection of the arcuate inner peripheral section 4 and the flat surface inner peripheral sections 5 and also serve as spaces for pressure release. Furthermore, the angle of the arcuate circumferential surface section 1 and flat surface section 2 of the drive shaft A inserted into the mounting hole $B_1$ serves to prevent the direct contact with the inner periphery of the mounting hole $B_1$.

Figure 2B:
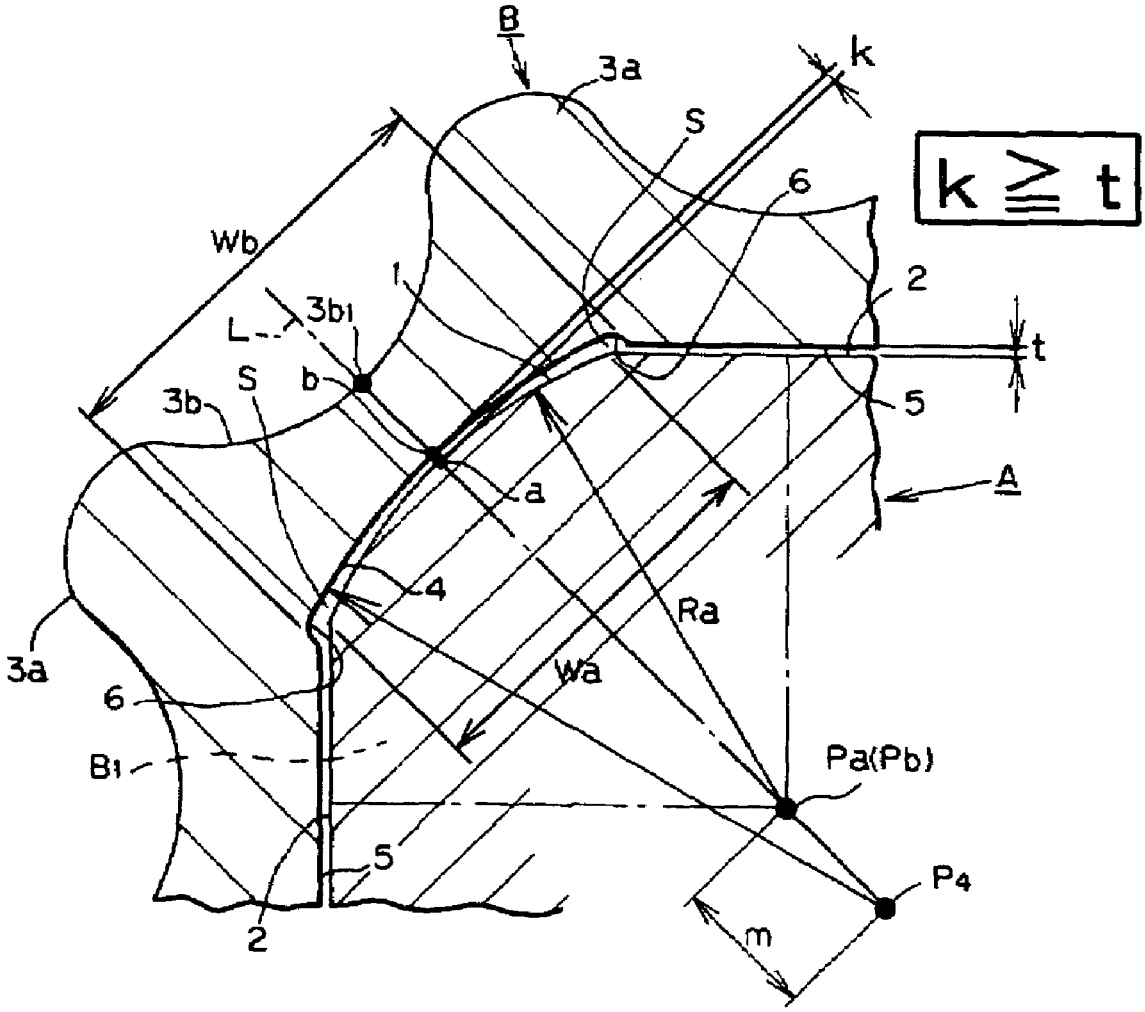

As shown in FIG. 2B, a pressure release channel section S is formed between the arcuate inner peripheral section 4 formed by the above-described configuration and the arcuate circumferential surface section 1 of the drive shaft A inserted into the mounting hole $B_1$. The pressure release surface area of the pressure release channel section S gradually expands toward both sides in the arc span direction between the arcuate circumferential surface section 1 and the arcuate inner peripheral section 4. In a state where the drive shaft A is inserted into the mounting hole $B_1$, a gap between the flat surface section 2 and the flat surface inner peripheral section 5 is taken as gap t.

Where a clearance in the middle point a of the arc span length Wa of the arcuate circumferential surface section 1 and the middle point b of the arc span length Wb of the arcuate inner peripheral section 4 is termed a clearance k, then the pressure release channel section S can be made a sufficient fluid channel even when clearance t is set to be equal to the clearance k. Actually the width of the clearance k is often set larger than that of the clearance t. Thus, the size relationship $k \geqq t$ is valid (see FIG. 2B). The pressure release channel section S has a shape such that the opening surface area thereof increases gradually toward both sides thereof, with the middle point a of the arc span length Wa of the arcuate circumferential surface section 1 and the middle point b of the arc span length Wb of the arcuate inner peripheral section 4 serving as centers, this shape being a planar open shape (see FIG. 2B).

The clearance t serves to insert the drive shaft A into the mounting hole $B_1$. Thus, the pressure release channel section S capable of sufficient pressure release can be formed between the arcuate circumferential surface section 1 and arcuate inner peripheral section 4, while maintaining a clearance (clearance t) necessary for inserting the drive shaft A into the mounting hole $B_1$.

Therefore, the thickness of the inner rotor B in the radial direction that is reduced by the formation of the mounting hole $B_1$ thereof can be suppressed to a minimum. As a result, a sufficient thickness can be ensured between the deepest section $3b_1$ of the tooth bottom 3*b* of the inner rotor B and the mounting hole $B_1$ even though the pressure release channel section S is provided, and the increase in the outer diameter of the inner rotor B can be prevented.

Figure 3A:
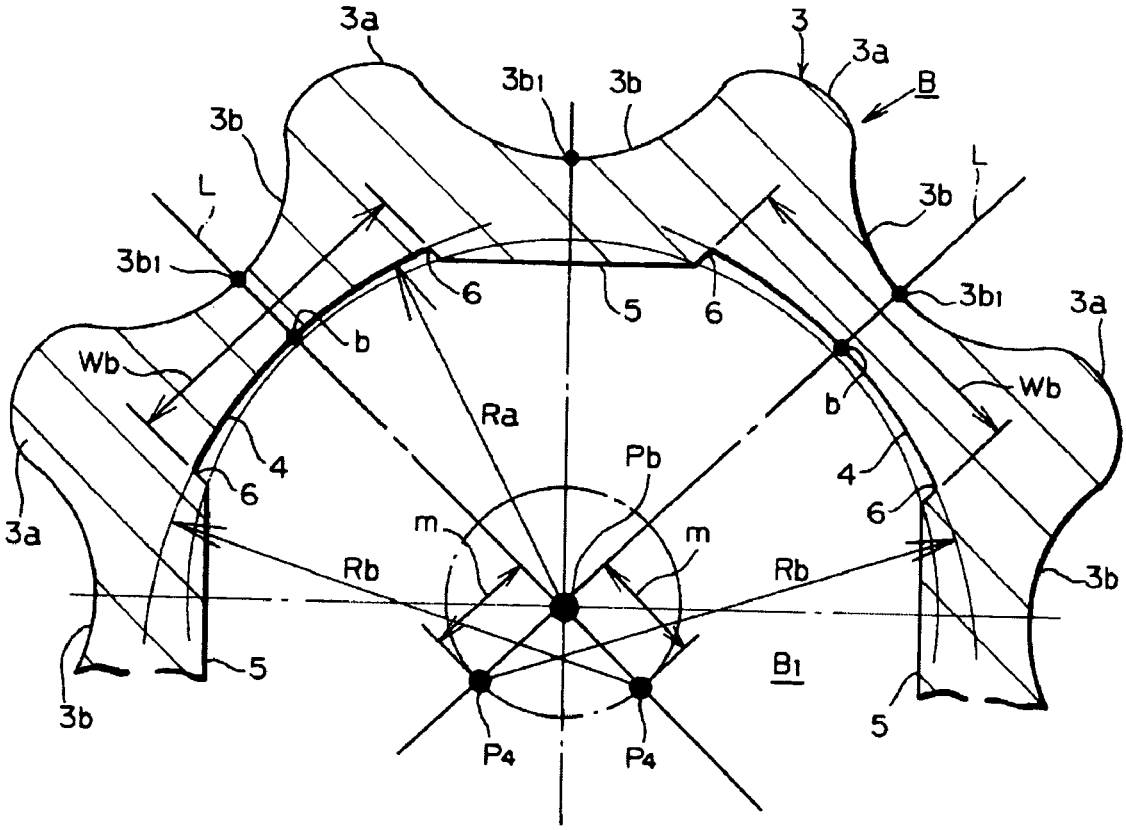
FIG. 3A is an enlarged cross-sectional view of the main part of the inner rotor in which the off-center distance of all the arcuate inner peripheral sections is the same, 33 is an enlarged view in which part of the view of 3A is cut out.

There are various types of the arcuate inner peripheral sections 4 of the mounting hole $B_1$. In the first type, the center $P_4$ of the arcuate inner peripheral section 4 is positioned on the line L passing through the middle point b of the arc span length Wb of the arcuate inner peripheral section 4 and the axial center Pb of the inner rotor B (see FIG. 2B, FIG. 3A). As for the center $P_4$ of the arcuate inner peripheral section 4 being positioned on the line L, positioning this center in the vicinity of the line L means setting to the almost identical position. With the mounting hole $B_1$ of the inner rotor B of this type, the best balance is obtained.

Figure 3B:
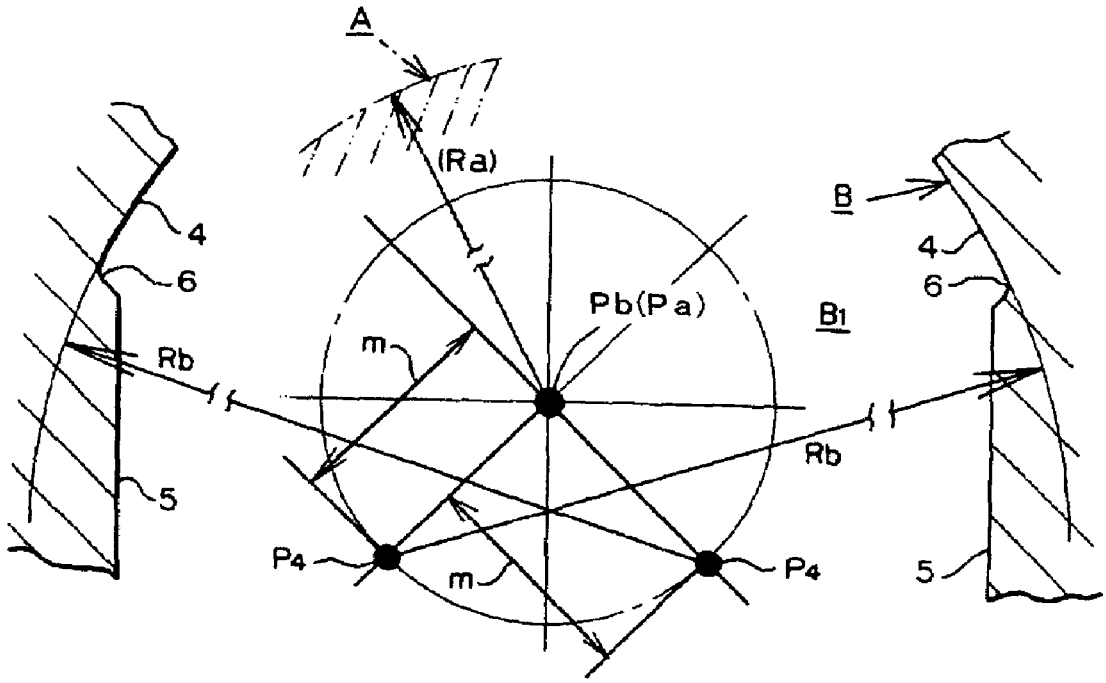

With the second type, the off-center distances m of the centers $P_4$ of the arcuate circumferential surface sections of all the arcuate inner peripheral sections 4 from the axial center Pb of the mounting hole $B_1$ are the same (see FIG. 3). Furthermore, in the third type, the off-center distance m of at least one center $P_4$ of the centers of all the arcuate circumferential surface sections is different from the off-center distances m of the centers $P_4$ of other arcuate circumferential surface sections.

Figure 4A:
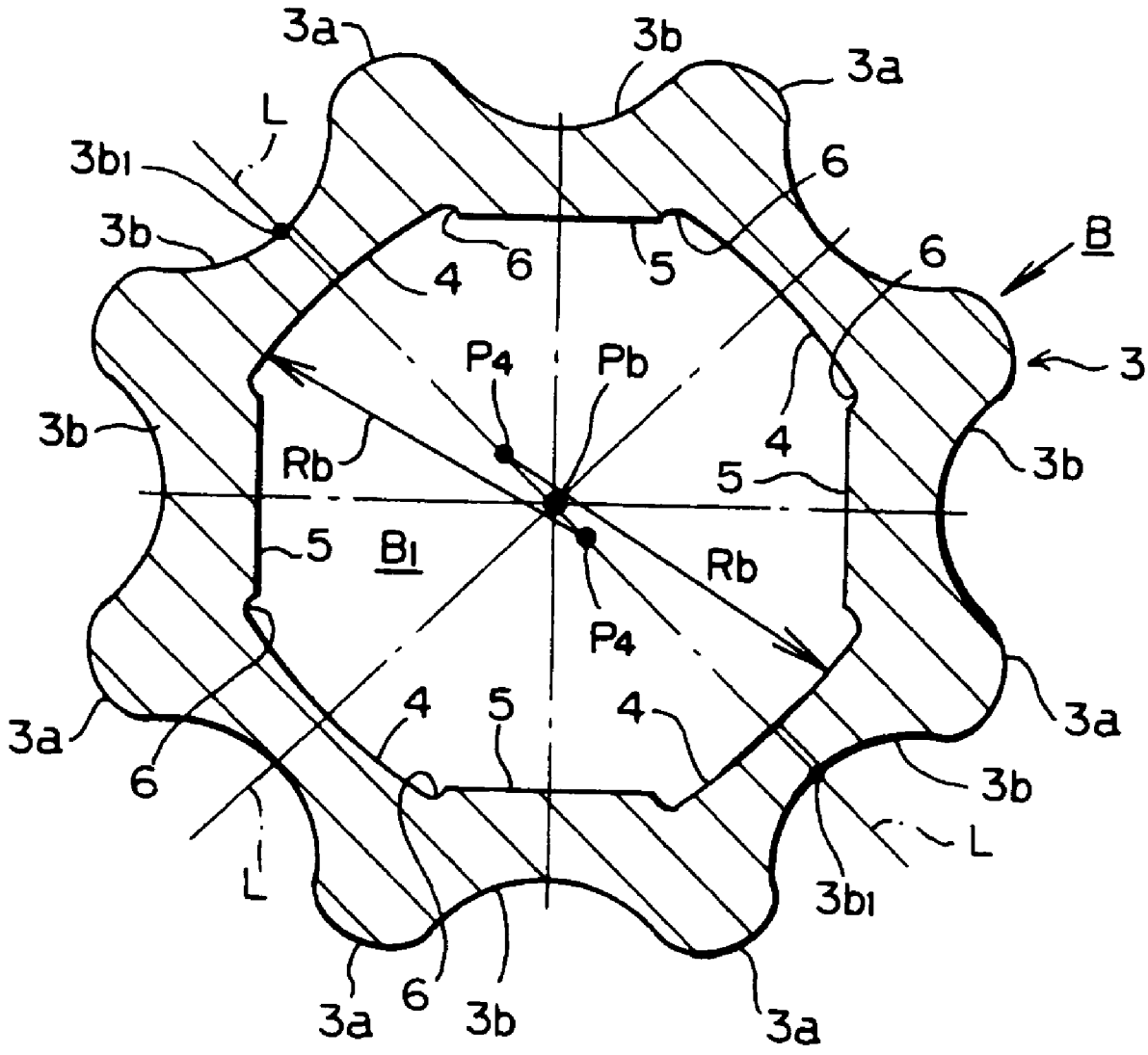
FIG. 4A is a vertical sectional front view of the inner rotor in which the off-center distance of an appropriate arcuate inner peripheral section is different from the off-center distances of other arcuate inner peripheral sections, 4B is the enlarged view of the main part of 4A.
Figure 4B:
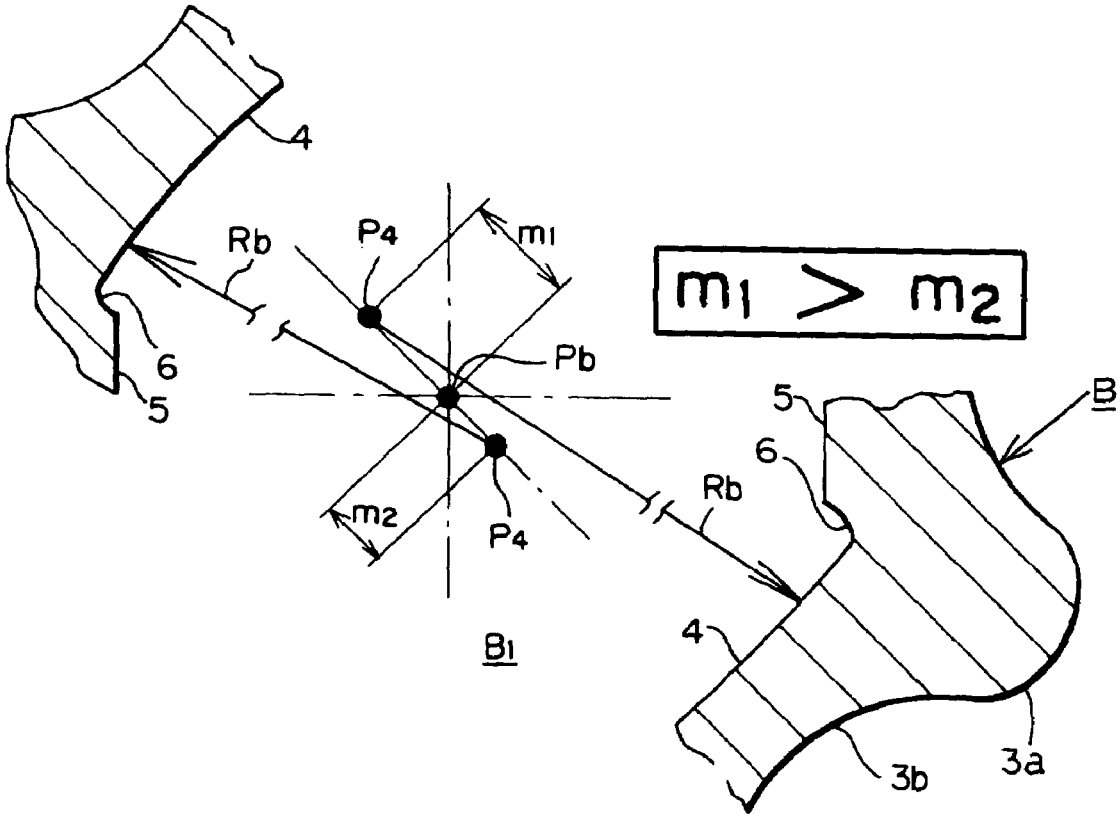

More specifically, where the off-center distance of the center $P_4$ of the arcuate inner peripheral section 4 with an appropriately larger curvature radius is denoted by $m_1$ and the off-center distance of other arcuate inner peripheral sections 4 with a small curvature radius is denoted by $m_2$, then the relationship between the off-center distances will be $m_1 > m_2$ (see FIG. 4B). Within this type, one off-center distance m of a plurality of off-center distances m, m, . . . can be different from the other remaining off-center distances m, or all the off-center distances m can have different numerical values.

Furthermore, in the fourth type, the radii Rb of all the arcuate inner peripheral sections 4 are the same. In the fifth type, at least one radius Rb of the radii of all the arcuate inner peripheral sections 4 is different from other radii Rb. Within this type, one radius Rb of a plurality of radii Rb, Rb, . . . can be different from the other remaining radii Rb, or all the radii Rb can have different numerical values. Furthermore, as the fifth type, the middle points b of the arc span length Wbs of all the arcuate inner peripheral sections 4 are set to correspond to the deepest sections $3b_1$ of the tooth bottoms 3*b* of the inner rotor B (see FIG. 2A, FIG. 3A).

In the fifth type, where the middle point b of the arc span length Wbs of the arcuate inner peripheral section 4 is positioned in the deepest section $3b_1$ of the tooth bottom 3*b* of the inner rotor B, the pressure release channel section S, which is formed, expands at both side thereof with the middle point b of the arc span length Wbs serving as a center, and the opening surface area of the pressure release channel section S increases in the portion of the tooth tip 3*a*. Therefore, a sufficient thickness in the deepest section $3b_1$ of the tooth bottom 3*b* in the pressure release can be ensured.

Furthermore, there is also a type in which the types from the first type through the fifth type are appropriately combined. For example, in the combination of the second type and the fourth type, the off-center distances m are the same and the radii Rb are the same. Furthermore, in the combination of the second type and the fifth type, the off-center distances m are the same, but radii Rb are different. In the combination of the third type and fourth type, the off-center distances m are different and the radii Rb are the same. Furthermore, in the combination of the third type and the fifth type, the off-center distances m are different and the radii Rb are different.

Figure 7A:
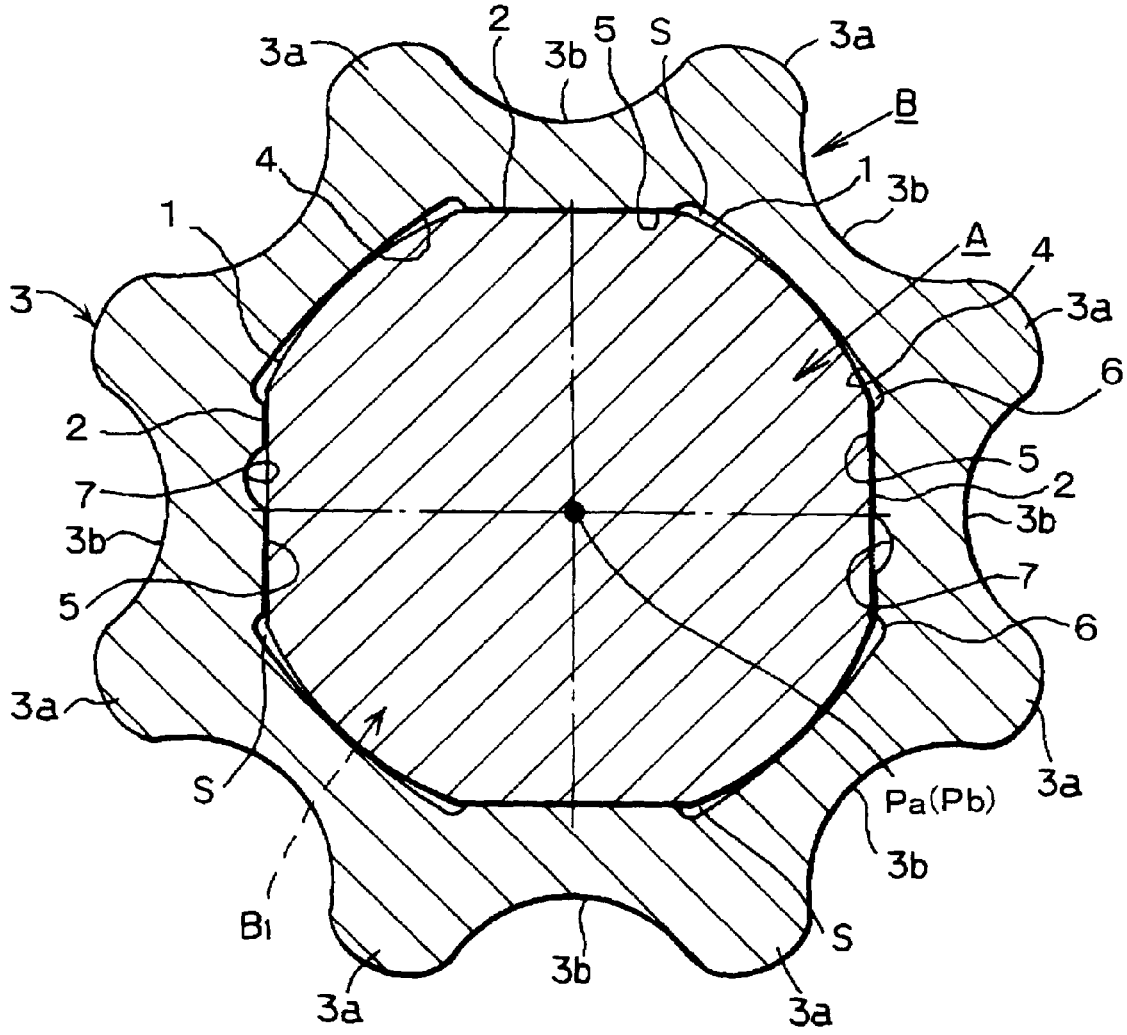
FIG. 7A is a vertical sectional front view of the drive shaft and the inner rotor having an escape groove formed therein, 7B is the enlarged view of the main part of 7A.
Figure 7B:
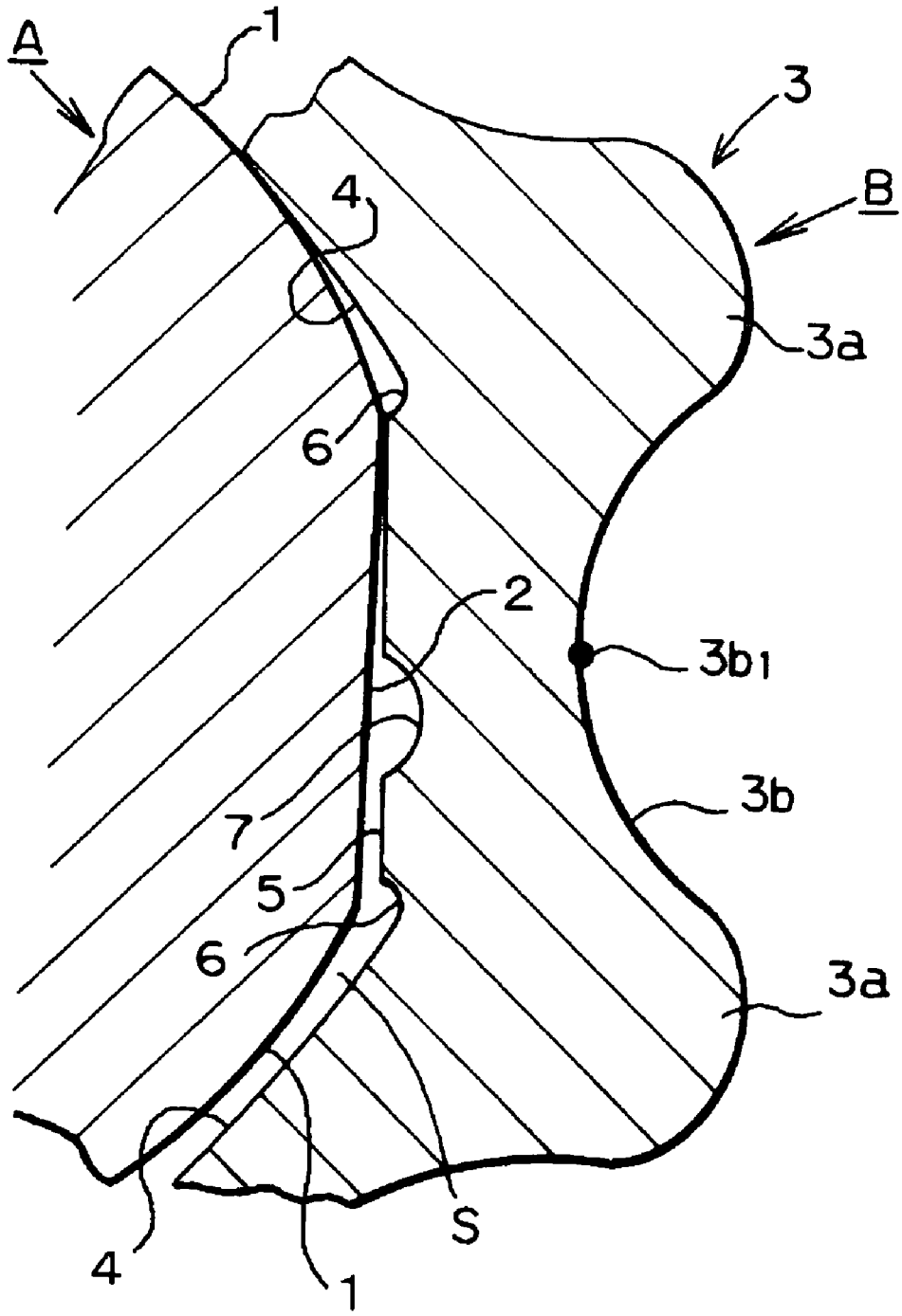

Further, there is an embodiment in which an escape groove 7 is formed, as shown in FIG. 7, in the flat surface inner peripheral section 5 of the mounting hole $B_1$. The escape groove 7 serves to ensure smooth pressure released from the pressure release channel section S. The escape groove 7 is preferably formed on one side in the rotation direction of the inner rotor B from the central position in the width direction of the flat surface inner peripheral section 5. The escape groove 7 is formed in all the flat surface inner peripheral sections 5 or in any one flat surface inner peripheral section 5.

What is claimed is:

1. A rotor apparatus of a pump, comprising:

a drive shaft in which a plurality of arcuate circumferential surface sections centering on an axial center and a plurality of flat surface sections are disposed alternately; and an inner rotor having a mounting hole into which said drive shaft is inserted, wherein in said mounting hole, arcuate inner peripheral sections corresponding and equal in number to said arcuate circumferential surface sections and flat surface inner peripheral sections corresponding and equal in number to said flat surface sections are formed alternately, wherein a plurality of centers of said arcuate inner peripheral sections are displaced with respect to an axial center of the inner rotor and radii of said arcuate inner peripheral sections are made larger than radii of said arcuate circumferential surface sections so that the axial center of said inner rotor is positioned between each arcuate inner peripheral section and a center of the radius corresponding to each arcuate inner peripheral section, and wherein a pressure release channel section bounded by the arcuate circumferential surface section and the arcuate inner peripheral section has a shape that increases gradually toward both sides thereof from a center of an arc span length of the arcuate circumferential surface section and a center of an arc span length of the arcuate inner peripheral section.

2. The rotor apparatus of a pump according to claim 1, wherein each of said plurality of centers of said each arcuate inner peripheral section is set in a position substantially identical to that on a line passing through a middle point of an arc span length of said arcuate inner peripheral section and the axial center of the inner rotor.

3. The rotor apparatus of a pump according to claim 2, wherein an off-center distance of the plurality of centers of all said arcuate inner peripheral sections are the same.

4. The rotor apparatus of a pump according to claim 2, wherein an off-center distance of at least one of the plurality of centers of all said arcuate inner peripheral sections is different from an off-center distance of another of the plurality of centers.

5. The rotor apparatus of a pump according to claim 2, wherein the radii of all said arcuate inner peripheral sections are the same.

6. The rotor apparatus of a pump according to claim 2, wherein the radius of at least one of all said arcuate inner peripheral sections is different from the radius of another of the arcuate inner peripheral sections.

7. The rotor apparatus of a pump according to claim 2, wherein the middle point of the arc span length of all said arcuate inner peripheral sections is in a position corresponding to a deepest section of a tooth bottom of said inner rotor.

8. The rotor apparatus of a pump according to claim 2, wherein corners of all said arcuate inner peripheral sections and flat surface inner peripheral sections are recessed arc-like corner sections.

9. The rotor apparatus of a pump according to claim 2, wherein, in said flat surface inner peripheral section, an escape groove is formed along an axial direction, and said escape groove is formed in said flat surface inner peripheral section and in a position corresponding to a position of a tooth tip of said inner rotor.

10. The rotor apparatus of a pump according to claim 2, wherein the plurality of centers of said arcuate inner peripheral sections are eccentric with respect to the axial center of the inner rotor.

11. The rotor apparatus of a pump according to claim 1, wherein an off-center distance of the plurality of centers of all said arcuate inner peripheral sections are the same.

12. The rotor apparatus of a pump according to claim 1, wherein an off-center distance of at least one of the plurality of centers of all said arcuate inner peripheral sections is different from an off-center distance of another of the plurality of centers.

13. The rotor apparatus of a pump according to claim 1, wherein the radii of all said arcuate inner peripheral sections are the same.

14. The rotor apparatus of a pump according to claim 1, wherein the radius of at least one of all said arcuate inner peripheral sections is different from the radius of another of the arcuate inner peripheral sections.

15. The rotor apparatus of a pump according to claim 1, wherein a middle point of the arc span length of all said arcuate inner peripheral sections is in a position corresponding to a deepest section of a tooth bottom of said inner rotor.

16. The rotor apparatus of a pump according to claim 1, wherein corners of all said arcuate inner peripheral sections and flat surface inner peripheral sections comprise recessed arc-like corner sections.

17. The rotor apparatus of a pump according to claim 1, wherein, in said flat surface inner peripheral section, an escape groove is formed along an axial direction, and said escape groove is formed in said flat surface inner peripheral section and in a position corresponding to a position of a tooth tip of said inner rotor.

18. The rotor apparatus of a pump according to claim 1, wherein at least one of the plurality of centers of said arcuate inner peripheral sections is eccentric with respect to the axial center of the inner rotor.

19. The rotor apparatus of a pump according to claim 1, wherein off-center distances of the plurality of centers of all said arcuate inner peripheral sections are different.

20. A rotor apparatus of a pump, comprising:

a drive shaft in which a plurality of arcuate circumferential surface sections centering on an axial center and a plurality of flat surface sections are disposed alternately; and an inner rotor having a mounting hole into which said drive shaft is inserted, wherein in said mounting hole, arcuate inner peripheral sections corresponding and equal in number to said arcuate circumferential surface sections and flat surface inner peripheral sections corresponding and equal in number to said flat surface sections are formed alternately, wherein centers of said arcuate inner peripheral sections are displaced with respect to an axial center of the inner rotor and also radii of said arcuate inner peripheral sections are made larger than the radii of said arcuate circumferential surface sections so that the axial center of said inner rotor is positioned between each arcuate inner peripheral section and a center of the radius corresponding to each arcuate inner peripheral section, and wherein at least one of the centers of said arcuate inner peripheral sections are eccentric with respect to the axial center of the inner rotor.

* * * * *